United States Patent [19]

Gray et al.

[11] 4,379,545

[45] Apr. 12, 1983

[54] SIDE LIFT JACK FOR UNIBODY AUTOMOBILES

[75] Inventors: Joseph L. Gray; James J. Gray, both of St. Joseph, Mo.

[73] Assignee: Gray Manufacturing Co. Inc., St. Joseph, Mo.

[21] Appl. No.: 241,436

[22] Filed: Mar. 6, 1981

[51] Int. Cl.[3] ..... B66F 3/00

[52] U.S. Cl. ..... 254/8 B; 254/124

[58] Field of Search ..... 254/124, 126, 3 R, 3 B, 254/3 C, 8 R, 8 B, 8 C, 2 R, 2 B, 2 C, 133, 134; 414/678

[56] References Cited

U.S. PATENT DOCUMENTS

| | | | |
|---|---|---|---|
| 405,664 | 12/1963 | Nielsen . | |
| 815,757 | 3/1906 | Stark . | |
| 867,549 | 10/1907 | Bentley et al. . | |
| 2,400,235 | 1/1945 | Johnson . | |
| 2,404,577 | 7/1943 | Jackson . | |
| 2,494,099 | 11/1948 | Mandelko et al. . | |
| 2,588,509 | 4/1948 | Forster . | |
| 2,730,903 | 8/1952 | Trautman et al. . | |
| 3,014,698 | 12/1961 | Arnes . | |
| 3,252,590 | 5/1966 | Nielsen | 254/126 |
| 3,268,208 | 8/1966 | Feilbach et al. | 254/2 B |
| 3,302,927 | 2/1967 | Gray | 254/2 B |
| 4,127,255 | 11/1978 | Wooding . | |

FOREIGN PATENT DOCUMENTS

| | | | |
|---|---|---|---|
| 143755 | 10/1951 | Australia | 254/126 |
| 1556608 | 11/1979 | United Kingdom | 254/124 |
| 753785 | 8/1980 | U.S.S.R. | 254/124 |
| 753786 | 8/1980 | U.S.S.R. | 254/124 |
| 765202 | 9/1980 | U.S.S.R. | 254/3 R. |

*Primary Examiner*—Robert C. Watson

*Attorney, Agent, or Firm*—Schmidt, Johnson, Hovey & Williams

[57] ABSTRACT

A jack assembly for side lifting of four wheel vehicles into tilted disposition is disclosed wherein elongated, rectilinear lifting arm means is provided which is of a length to extend substantially across the track dimension of the vehicle when the arm means is inserted under the vehicle from one side thereof. Extensible fluid actuated means is operably connected to the normally outboard end of the lifting arm means for swinging the arm means through an arcuate displacement to engage and lift one side of the car as the arm means pivots about the inboard end thereof which rests on the ground. The jack is especially useful for raising one side of smaller unibody automobiles without damage to the body or operating components.

14 Claims, 9 Drawing Figures

SIDE LIFT JACK FOR UNIBODY AUTOMOBILES

BACKGROUND OF THE INVENTION

1. Field of the Invention

This invention relates to jack assemblies especially useful for raising one side of four wheel vehicles such as cars or trucks and is particularly useful for raising smaller vehicles of the unibody type without damage to the body or frame defining components of the vehicle.

Automobiles and trucks of the unibody type which do not have a separate, monolithic frame serving to provide lift points that distribute stresses imposed thereon over a large area of the vehicle present jacking problems because portions of the body function as frame defining elements which can be damaged if localized forces are applied thereto. In the case where individual, independent frames are provided upon which the vehicle body rests and is secured thereto may often be jacked up by applying a force to bumpers at opposite ends of the vehicle by virtue of the fact that the bumpers are connected directly to opposed extremities of the frame. However, as indicated, unibody vehicles do not offer these jacking points whereby one or more wheels may be lifted off the ground either to change tires or for working on the underside of the vehicle. So called "world" class automobiles now being manufactured and distributed on a worldwide basis are for the most part of the unibody type wherein elevation of a part thereof for tire changing or maintenance purposes using a portable lift as contrasted with a conventional in place, all vehicle floor hoist, must be accomplished from the side of the vehicle as the latter is tilted to raise both wheels on the one side of the vehicle off of the ground while the two remaining ground engaging wheels along with a suitable jack assembly serve as supports for the car or truck. The side rocker panels of these vehicles merge into and are joined to the floor member of the vehicle which is suitably reinforced to act as the central "frame" of the automobile or truck. If a jack is placed under the zone of merger of the rocker member with the floor panel, there is a tendency for the localized forces applied thereto to deflect and bend the metal thereby causing permanent damage to the vehicle. Although some manufacturers provide spaced, outwardly directed, open end tubes for receiving jack extensions which may be telescoped into the tubes for effecting a lifting force thereon, this requires special jacks, the vehicle can be lifted only at particular points along the length thereof, and a jack of the required type is often times not available since the jack receiving tubes may vary from vehicle to vehicle.

2. Description of the Prior Art

As indicated, jacks are known for lifting unibody four wheel vehicles such as cars or trucks wherein an extension is adapted to be telescopically received within a suitable sleeve provided therefor which is a permanent part of the vehicle along the length of the rocker panels thereon. The actual jack assemblies are generally of the ratchet type wherein reciprocation of a operating arm causes a toggle pawl and dog unit to alternately engage the rack of the jack and lift the same while a dog then moves into a rack tooth to hold the rack in an elevated position as the lever is returned to its initial position to allow another bite to be taken on the rack. These jacks are not suitable for lifting the vehicle other than at the prescribed points along the length of the rocker panels where the extensions on the jack can be suitably received in special sleeves therefore.

Bumper jacks are not suitable alternatives for many four wheel unibody vehicles because the bumpers are not attached to a one piece frame which causes the lifting forces to be imposed on the frame itself before being transmitted to the body resting thereon.

The assignee of this application was issued U.S. Pat. No. 3,780,987 for lifting heavy equipment such as fork-lift trucks wherein one of the lifting arms of a scissors arrangement has a fulcrum point on the ground so that the extension means moves toward and away from the fulcrum point during raising and lowering of an object carried by the lift arm of the assembly, but this jack is not adapted for raising world class cars or the like of unibody design.

Furthermore, during the lifting sequence, the scissors which engages the load to raise the same, moves in one direction of rotation through a controlled arc, while the other scissors arm of the linkage moves through a rotational arc in the opposite direction. A design that does not have this complexity of components and operation is inherently less costly.

SUMMARY OF THE INVENTION

It is therefore a primary object of the present invention to provide a side lift jack assembly for four wheel vehicles of the unibody type wherein elongated lift arm means is provided which is adapted to be slipped under the vehicle from the side and extensible means then actuated to pivot the lifting arm about a fulcrum point defined by the endboard ground engaging extremity of the lift arm means to cause the latter to move into engagement with the underside of the vehicle and raise one side thereof to tilt the vehicle and provide access to the elevated wheels and at least a portion of the underside of the car or truck. The lifting arm is integrally attached to the extension cylinder for rotation by the latter whereby the extensible unit and lift arm both move through the same rotational arc and in the same direction thus greatly simplifying the assembly and decreasing its cost. Suitable flexible pad means is provided on the lift arm for engaging the underside of the vehicle at the zone of merger of a rocker panel with the floor of the car or truck to impart a lifting force to the vehicle without damaging or in any way deforming the metal panels of the car or truck.

A further important object of the invention is to provide a relatively inexpensive side lift jack assembly for unibody vehicles which has as its primary components an elongated lifting arm of a length such that when the arm is slipped under a vehicle to be raised from one side thereof, the arm extends across substantially the entire track width of the vehicle whereby by virtue of rigid connection of the fluid actuated extensible means to the outboard end of the lifting arm, such arm is caused to swing through an arc about the fulcrum point defined by the endboard into the arm resting on the ground beneath the vehicle to bring the flexible pad on the lifting arm into engagement with the underside of the body and thereby raise the latter into tilted disposition with both wheels on one side of the vehicle off the ground while the vehicle is supported by the two opposed side wheels and the lift arm of the jack assembly.

Another important object of the invention is to provide a side lift jack assembly as described which even though having a relatively long lift arm as described is sufficiently maneuverable that it may readily be pushed between two side by side vehicles in parallel relationship and then turned into disposition with the lift arm extending under the car or truck to allow ready lifting and tilting of the same into disposition for work on the vehicles wheels on one side thereof, or on the underside of the body.

DESCRIPTION OF THE PREFERRED EMBODIMENT

Figure 3:
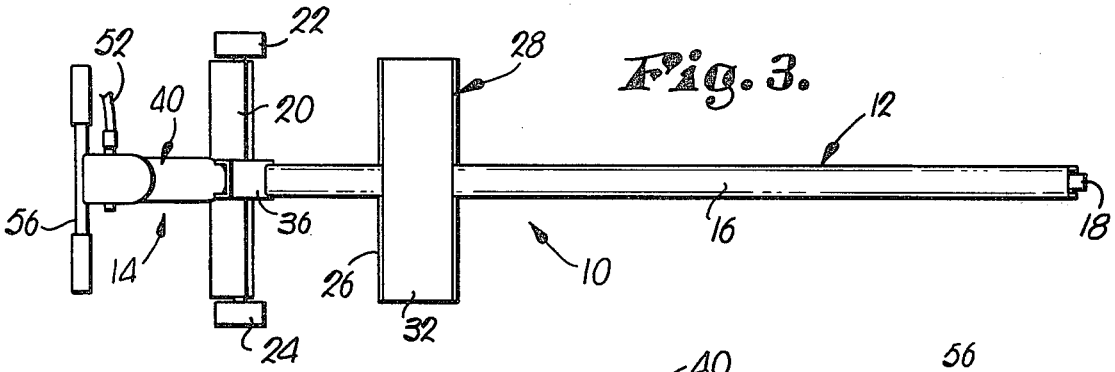
FIG. 3 is a plan view of the side lift jack assembly.

A side lift jack for four wheel vehicles, particularly of the unibody type is broadly designated by the numeral 10 in the drawings and includes as main components, elongated lifting arm means 12 adapted to be positioned under the vehicle to be lifted from one side thereof and of a length to extend across substantially the full track dimension of the car or truck, along with fluid actuated extensible means 14 secured to the normally outboard end of lifting arm means 12.

Figure 1:
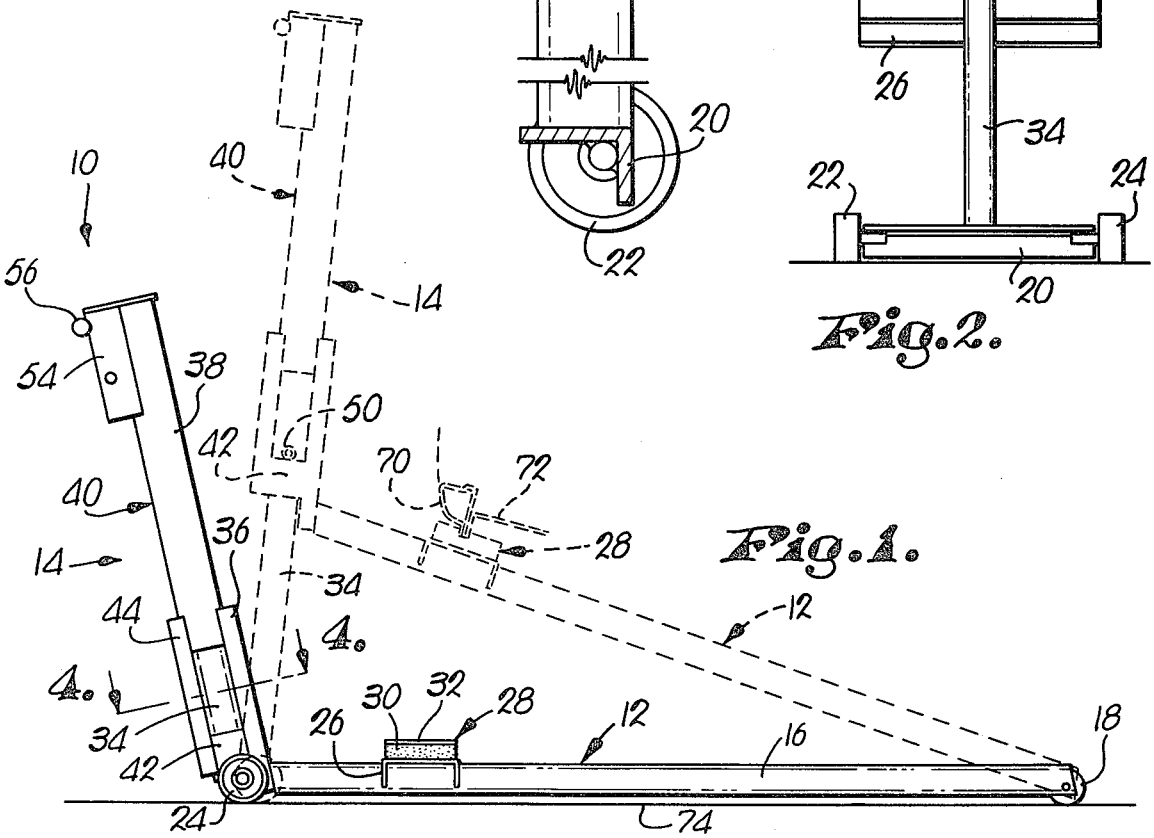
FIG. 1 is a side elevational view of a side lift jack assembly for unibody four wheel vehicles such as cars and trucks with the normal transport position thereof being illustrated in full lines, while an elevated disposition of the lift arm is shown by dashed lines and depicting the way in which the lift arm may engage the zone of merger of a rocker member and the floor panel of a vehicle to exert a lifting force on one side thereof.
Figure 7:
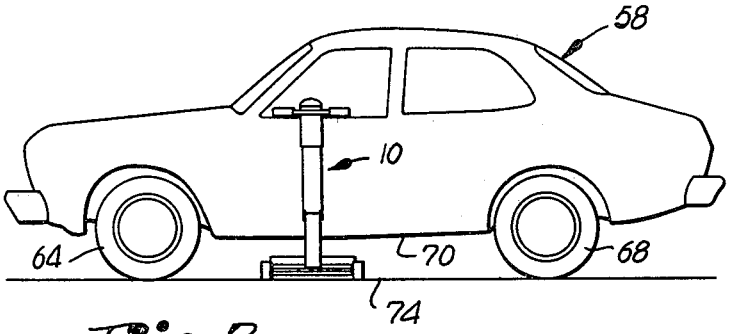
FIG. 7 is an end elevational view of the jack assembly as well as a depiction of one side of an automobile to be lifted, showing the disposition of the jack relative to the car for raising one side of the latter.
Figure 8:
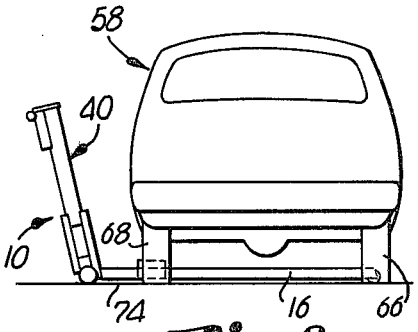
FIG. 8 is a side elevational view of the jack assembly and showing the rear of the vehicle to be lifted to better illustrate the disposition of the jack relative to the side of the vehicle for lifting purposes.

As is most evident from FIG. 1, lifting arm means 12 includes an elongated tubular, transversely square arm 16 which mounts a ground engaging transport wheel 18 on the outermost end thereof which is rotatable about an axis transverse of the longitudinal length of the arm. The opposite end of tubular arm 16 terminates near but is not directly connected to a transversely extending angle support 20 which in turn mounts ground engaging transport wheels 22 and 24 at opposite ends thereof for rotation about a common axis which is parallel with the axis of rotation of transport wheel 18. It is to be noted from FIG. 3 that the support arm 20 along with arm 16 and associated wheels 18, 22 and 24 define a substantially triangular base which imparts inherent stability to jack 10 under varying ground terrain conditions. Arm 16 is of substantial length and desirably extends at least about one half of the distance represented by the track dimension of a vehicle to be raised and preferably of a longitudinal length such that the arm extends across the entire width of the vehicle to be lifted when in operative disposition as illustrated in FIGS. 7 and 8 of the drawings.

Vehicle support element means includes a channel member 26 welded or otherwise affixed to arm 16 in transversely extending relationship thereto with the bight portion of the channel in generally flush, parallel relationship to the upper face of tubular arm 16. As an alternate to welding, the channel member 26 may be bolted or attached to arm 16 in a manner than allows adjustable fixation along the length of the lifting arm at any one of a number of selected, predetermined positions therealong. Channel member 26 is of substantially less length than the overall longitudinal length of arm 16 and is positioned a distance from the angle support 20 to be strategically located under the zone of merger of a rocker panel of a vehicle with the floor section thereof, when jack 10 is in a vehicle lifting position as shown for example in FIG. 8. A pad generally designated 28 is secured to the upper bight portion of channel member 26 in overlying, covering relationship thereto and is made up of a relatively dense, foam rubber element 30 and an overlying neoprene rubber impregnated fiberglass sheet 32 adhered to the upper face of the foam element. Sheet 32 provides frictional engagement of lift arm means 12 with the underside of the vehicle so that no slippage occurs therebetween. The foam rubber element prevents damage to the components of the vehicle by virtue of the resilient nature thereof, while the sheet 32 precludes the underside of the vehicle from damaging the foam rubber element 30.

Figure 4:
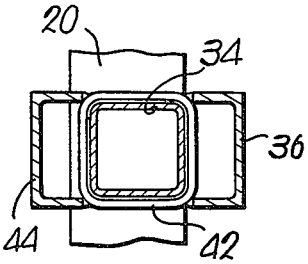
FIG. 4 is an enlarged, fragmentary, horizontal crossectional view taken substantially along the line 4—4 of FIG. 1 and looking downwardly in the direction of the arrow.

Fluid actuated extensible means 14 includes a tubular, transversely rectangular post 34 welded to the upper face of the angle support 20 intermediate the ends thereof and located at an obtuse angle of somewhat greater than 100° relative to the longitudinal axis of arm 16 of lifting arm means 12. An upright channel 36 is welded to the end of arm 16 proximal to angle support 20 and is also welded to the lower end of the cylinder 38 of a piston and cylinder assembly broadly designated 40. The lower end of channel 36 is welded to a box sleeve 42 (FIGS. 1 and 4) which surrounds and is slidable along the length of square post 34. Another connector channel 44 in direct opposition to channel 36 is welded to the backside of box sleeve 42 as well as the lower end of cylinder 38. Post 34 along with the angle 20 and wheels 22, 24 serve as ground support components while cylinder 38 of extensible means 14 comprise structure which is welded or otherwise rigidly affixed to arm 16. As a result, during extension and retraction of extensible means 14, the latter pivots about the ground support point therefore through the same arcuate path and in the same direction at all times as described by arm 16.

Figure 5:
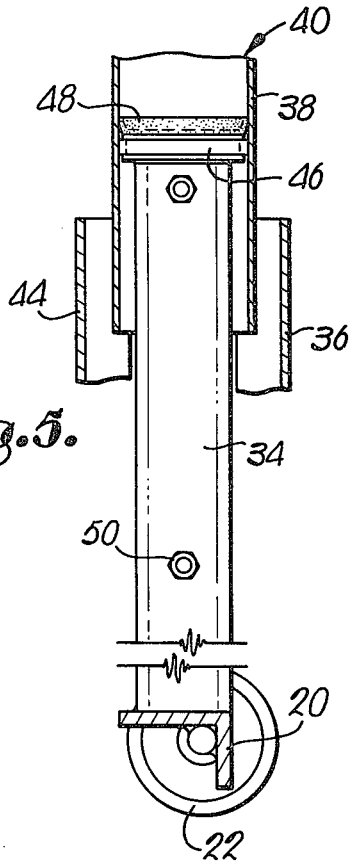
FIG. 5 is an enlarged, fragmentary, essentially vertical crosssectional view down through the fluid actuated extensible means of the jack and showing the lower support structure as well as the piston and cylinder assembly of the actuating means.
Figure 2:
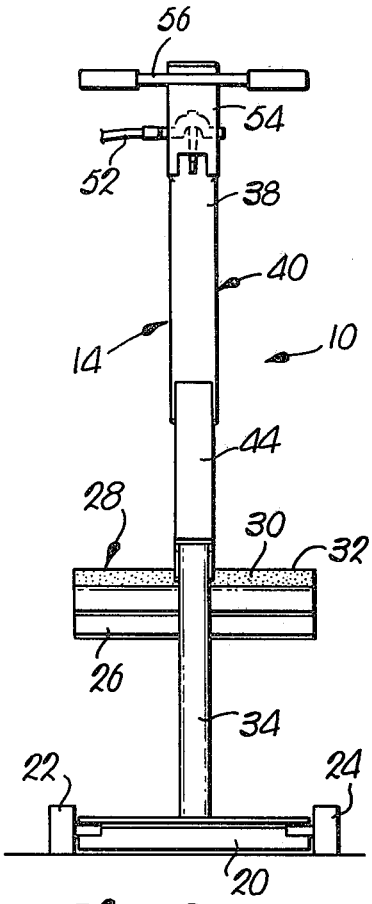
FIG. 2 is a rear elevational view of the side lift jack assembly as shown in FIG. 1.

The uppermost end of post 34 is suitably connected to the piston 46 of assembly 40 which has a diaphragm 48 on the upper face thereof for fluid sealing engagement with the inner surface of cylinder 38. Stop 50 (FIGS. 1 and 5) projecting from one face of the post 34 and engageable with the upper edge of box sleeve 42 when extensible means 14 is extended limits the shifting movement of piston and cylinder assembly 40 relative to post 34.

A fluid supply line 52 connected to the upper end of cylinder 38, communicating with the interior thereof above piston 46, and having suitable valve and orifice means associated therewith, allows controlled supply of air to assembly 40 upon raising of the vehicle as well as release of such air from the cylinder when the car or truck is lowered. Structure 54 at the rear upper end of cylinder 38 carries a transversely extending, generally horizontal handle 56 to facilitate operator control of side lift jack 10.

Operation

Figure 6:
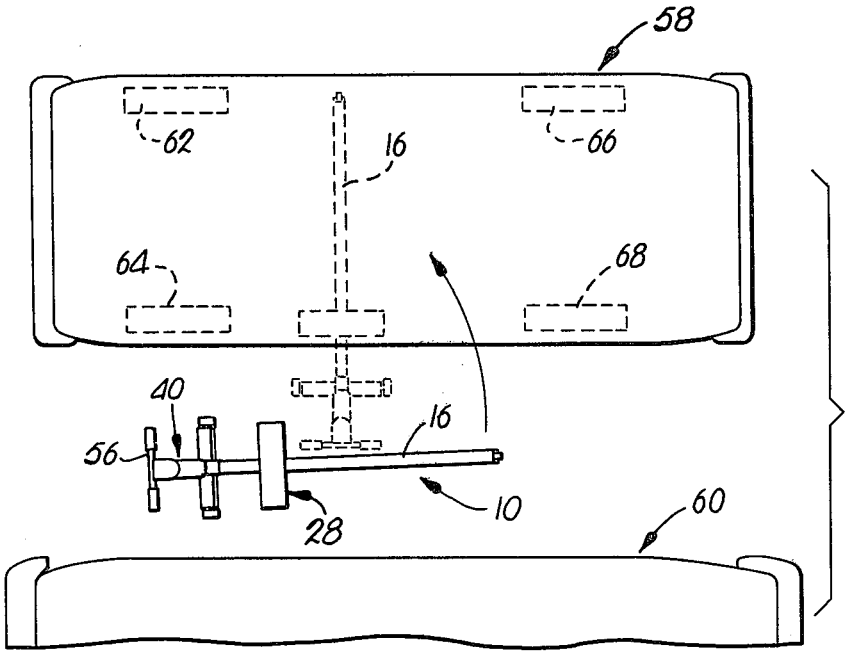
FIG. 6 is a fragmentary, generally planar view in somewhat schematic format illustrating the way in which the jack assembly of this invention may be moved between two vehicles in side by side, generally parallel relationship, and then swung through a 90° arc to slip the lifting arm of the jack beneath the vehicle to be lifted from one side thereof.

In the use of side lift jack 10, the operator may readily maneuver the same between two parked vehicles 58 and 60 for example into a location as shown in FIG. 6 whereupon by simply pivoting the jack through an arc of about 90°, the elongated lifting arm means 12 may be turned beneath vehicle 58 for instance between front wheels 62 and 64 and rear wheels 66 and 68 respectively. As is best shown in FIGS. 6 and 8, arm 16 is of a length to span substantially the entire track dimension of the vehicle 58 when pad 28 is located immediately inside of the rocker panel 70 against the floor section 72 or directly beneath the zone of merger of the rocker panel 70 of vehicle 58 with the floor section 72 thereof as shown in FIG. 1. The very low profile of lifting arm means 12 allows the arm 16 to be inserted beneath vehicle 58 without engagement with any of the operating components of the latter.

Figure 9:
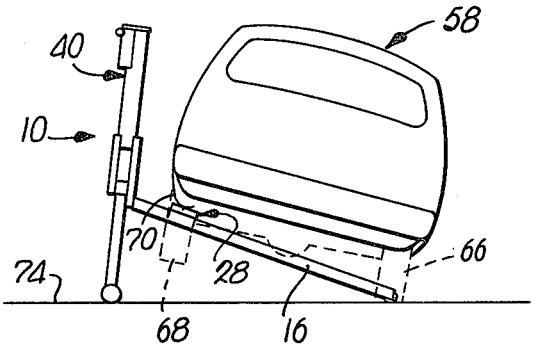
FIG. 9 is a view similar to FIG. 8 but illustrating the tilted disposition of the car as it has been lifted by the jack assembly hereof.

Raising of one side of the car 58 is accomplished by the simple expedient of directing pressurized air into the interior of cylinder 38 via supply line 52 whereby cylinder 38 and the associated end of lifting arm 16 integrally attached thereto are caused to rise vertically as arm 16 pivots about a fulcrum represented by the point of engagement of wheel 18 with the ground support 74. It is to be noted in this respect particularly from viewing FIG. 1 that during such upward movement of the extensible means 14 and consequent swinging of lifting arm means 12 about a pivot point represented by the engagement of wheel 18 with the ground 74, the fluid actuated extensible means 14 also swings through the same arc and in the same direction as the arm. At the maximum height of the jack, extensible means 14 leans slightly forward toward the car whereas in the normal transport disposition of jack 10 as shown by the full lines in FIG. 1, extensible means 14 leans away from the vehicle. This arrangement is advantageous in that there are no complicated parts or complex geometrical relationships involved and the lift arm is quickly and positively brought into engagement with the vehicle and the rotation positively continued to effect smooth and rapid lifting of one side of the vehicle. Furthermore, there is no tendancy for the jack mechanism to engage and mar the outer surface of the vehicle at the time of placement of the jack in position as shown in FIGS. 7 and 8, or throughout the time of lifting of the vehicle to tilted disposition as shown in FIG. 9 wherein vehicle 58 rests on and is supported by the side wheels 62 and 66 as well as lifting arm means 12. When the fluid actuated extensible means 14 is fully extended as represented by engagement of box sleeve 42 with stop 50, arm 16 as well as the extensible means 14 joined thereto has been swung through an arc of approximately 20°.

Not only does side lift jack 10 efficiently and effectively raise unibody type automobiles and trucks into tilted disposition as indicated in FIG. 9 without damage to the body or underside components, but the car in lifted disposition is highly stable without significant danger of tipping. As a consequence, the operator may locate the jack in a number of positions along the length of a vehicle to be raised without regard for the specific location of integral lifting attachments or sleeves provided for that purpose. Furthermore, the jack may readily be maneuvered into desired disposition even in tight quarters and rapid elevation and lowering of the vehicles is accomplished with minimum operating components. This decreases the overall cost of the side lift jack as well as renders the same substantially maintenance free for a long and useful life.

We claim:

1. A jack assembly for tilting a four wheel vehicle off the ground, comprising:

elongated lifting arm means presenting an inner end and an outer end;

upright post means including extensible means; and means rigidly connecting said post means and arm means adjacent said inner end of the latter to present an included obtuse angle between the arm means and post means, said arm means being constructed and arranged for positioning at least partially under said vehicle from one side thereof and of a length to extend across the width of the vehicle from said one side with said outer end engaging an outer contact area on the ground more than one-half of the wheel track dimension of said vehicle, said assembly having inboard ground-engaging means for engaging an inner contact area on the ground proximal to said post means, said extensible means including means for swinging the arm means through an arc to engage the vehicle and extert a tilting force thereon, said included angle remaining constant during said travel of said arm means with said outer end of said arm means pivoting adjacent said outer contact area, and with said inboard ground-engaging means shifting along said ground, at least a portion of said shifting being toward said vehicle.

2. A jack assembly as set forth in claim 1 wherein said lifting arm means is of an effective length to extend substantially across the wheel track dimension of the vehicle to be lifted when the lifting arm means is beneath the vehicle with the extensible means adjacent said one side of the vehicle.

3. A jack assembly as set forth in claim 1 wherein said extensible means includes components adapted to rest on the ground and structure joined to the lifting arm means and movable through the same arcuate path followed by the lifting arm means and in the same direction during swinging thereof by extension of the extensible means.

4. A jack assembly as set forth in claim 3 said structure including fluid actuated means reciprocably mounted on said post means, and connector means rigidly securing the fluid actuating means to the lifting arm means for movement therewith and operable to raise the latter relative to the post means during supply of fluid to the fluid actuated means.

5. A jack assembly as set forth in claim 4 wherein said connector means includes sleeve means surrounding the post means and slidably positioned on the post means whereby the post means moves through a fore and aft rotational path about a horizontal axis adjacent the ground as the extensible means is operated to raise or allow lowering of the lift arm means.

6. A jack assembly as set forth in claim 5 wherein said fluid actuated means includes a piston and cylinder assembly, said sleeve means being rigidly coupled to said cylinder and the piston being joined to and directly coupled to the post means.

7. A jack assembly as set forth in claim 1 wherein is provided wheel means on said extensible means and the lifting arm means to facilitate maneuvering of the jack assembly into and out of disposition with the lifting arm means extending beneath a vehicle to be lifted from the side thereof.

8. A jack assembly as set forth in claim 7 wherein is provided horizontally extending handle means on said extensible means to allow selective guiding of the lifting arm means as it is inserted under or removed from beneath a vehicle.

9. A jack assembly as set forth in claim 1 wherein is provided pad means carried by the lifting arm means directly engageable with the vehicle and mounted for movement with the arm means through substantially the same arcuate path followed by the arm means during operation of said extensible means.

10. A jack assembly as set forth in claim 9 wherein said pad means includes vehicle support element means rigidly secured to the lifting arm means in transversely extending relationship thereto and located in closer proximity to said extensible means than to said opposite end of the lifting arm means.

11. A jack assembly as set forth in claim 10 wherein said element means includes a resilient pad member mounted on and carried by the lifting arm means for engaging the underside of the vehicle to be lifted.

12. A jack assembly as set forth in claim 1 wherein said lifting arm means includes an elongated rectilinear arm member of a length to extend across substantially the entire track dimension of the vehicle when the jack assembly is in normal vehicle lifting disposition.

13. A jack assembly as set forth in claim 12 wherein is provided a wheel on said outer end of the arm member remote from said extensible member, there being a pair of wheels on the extensible member in horizontally spaced relationship, one on each side of the longitudinal axis of the lifting arm member, all three of the wheels being disposed to engage the ground and rotatable about axes which are parallel one to another.

14. A jack assembly as set forth in claim 1 wherein said lifting arm means and the extensible means are constructed and arranged to cause the lifting arm means to be substantially at ground level in generally parallel relationship thereto in the lowered position of the same while the extensible means is operable to raise the lifting arm means to an angle of about 30° relative to the horizontal in the uppermost elevated location of the same.

* * * * *